US006158969A

United States Patent [19]

Graf et al.

[11] Patent Number: 6,158,969

[45] Date of Patent: Dec. 12, 2000

[54] HYDROSTATIC PUMP AND DISABLE CONTROL THEREFOR

[75] Inventors: Kevin J. Graf, Eden Prairie; Jerry D. Schrag, Savage, both of Minn.

[73] Assignee: Eaton Corporation, Cleveland, Ohio

[21] Appl. No.: 09/397,696

[22] Filed: Sep. 16, 1999

[51] Int. Cl.[7] ..... F04B 1/26

[52] U.S. Cl. ..... 417/222.1; 417/506; 417/222; 91/506; 91/3; 60/445; 137/83

[58] Field of Search ..... 417/222.1, 222, 417/506; 91/506, 3; 60/45; 137/83

[56] References Cited

U.S. PATENT DOCUMENTS

| | | | |
|---|---|---|---|
| 3,401,711 | 9/1968 | Kubilos | 137/83 |
| 3,733,963 | 5/1973 | Kubilos | 91/3 |
| 3,736,073 | 5/1973 | Walmsley | 417/222 |
| 3,803,987 | 4/1974 | Knapp | 91/506 |
| 4,050,247 | 9/1977 | Connett | 60/444 |
| 4,116,602 | 9/1978 | Knapp et al. | 60/445 |
| 5,226,349 | 7/1993 | Alme et al. | 91/506 |
| 5,378,127 | 1/1995 | Welscher | 417/506 |
| 6,030,182 | 2/2000 | Voigt | 417/222.1 |
| 6,068,451 | 5/2000 | Uppal | 417/222.1 |

OTHER PUBLICATIONS

Eaton Corporation drawing of Control Valve Assembly Number 34673–AAV (Two pages).

*Primary Examiner*—Timothy S. Thorpe
*Assistant Examiner*—Steven Brown
*Attorney, Agent, or Firm*—L. J. Kasper

[57] ABSTRACT

A variable displacement hydrostatic pump (11) having its displacement varied by a controller (17) in response to movement of a manual control lever (95) from a neutral position (FIG. 1). The vehicle has at least one other device (125,127) which provides an electrical output signal (133) indicating when operation of the pump (11) is "acceptable", in terms of either vehicle performance or operator safety. Associated with the control lever (95) is an input shaft (103) defining at least one stop surface (121,123). A solenoid assembly (109) has a moveable plunger (111), disposed adjacent the stop surfaces, and moveable between a retracted position (FIG. 4*a*) and an extended position (FIGS. 2 and 4), engaging one of the stop surfaces, when the output signal (133) indicates that operation of the pump is not acceptable.

5 Claims, 3 Drawing Sheets

HYDROSTATIC PUMP AND DISABLE CONTROL THEREFOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to variable displacement hydrostatic pumps, and more particularly, to such pumps of the type wherein the pump displacement is controlled, either directly or indirectly, in response to movement of a manual input member (control lever).

Many variable displacement hydrostatic pumps of the type to which the present invention relates are utilized in the field of mobile hydraulics, i.e., as part of the hydraulic system of various types of vehicles. Furthermore, many such pumps are utilized in the propel circuit of the vehicle, to supply fluid under pressure to a fluid motor which transmits torque to the drive wheels of the vehicle. Therefore, although the present invention is not limited to use in a pump which is part of a vehicle propel circuit, such is an especially advantageous application of the invention, and the invention will be described in connection with such a circuit.

It is typical for vehicles having hydrostatic propel circuits also to include one or more devices or functions which require some assurance that the hydrostatic pump is in neutral. For example, if the vehicle is equipped with brakes having hill-holding capability, it is important that the pump not be displaced from its neutral position whenever the brakes have been applied. In other words, it would not be desirable to permit the vehicle to "drive through" the brakes.

As another example, many such vehicles are equipped with an operator seat switch which serves as a safety feature by sensing the presence of the vehicle operator in the seat and sending an electrical signal to enable operation of various vehicle functions, but only in response to the operator being in the seat. For example, a number of vehicles have been provided with an electrical operator seat switch, connected to the engine ignition system, such that the vehicle engine can not be started unless the operator is sitting in the operator seat. Such an arrangement is helpful, but once the engine is already running, the seat switch has effectively been bypassed, and the pump can be displaced in situations in which displacement of the pump is not appropriate.

On vehicles having variable displacement hydrostatic pumps as part of the propel circuit, wherein pump displacement is varied by manual movement of a manual control lever, one of the problems in the operation of the vehicle is that, periodically, the operator or someone else will accidentally move the manual control lever in a situation in which movement of the vehicle is not desired. For example, as the vehicle operator is climbing onto the vehicle, in preparation for sitting in the operator seat, if the operator accidentally grabs or bumps the control lever, the vehicle will begin to move, and perhaps rather suddenly, in either a forward or reverse direction. With the operator not expecting the vehicle to move at that time, and perhaps not being in the operator seat, such premature movement of the vehicle can present a safety concern.

BRIEF SUMMARY OF THE INVENTION

Accordingly, it is an object of the present invention to provide an improved variable displacement hydrostatic pump which overcomes the above-described disadvantages of the prior art.

It is a more specific object of the present invention to provide an improved variable displacement hydrostatic pump which can be prevented from being displaced from its neutral, non-pumping condition in response to the existence of a predetermined condition of certain other vehicle devices or functions.

It is a further object of the present invention to provide an improved variable displacement hydrostatic pump which accomplishes the above-stated objects, without the need for any substantial redesign of the pump, and without the need for any major additional pump control structure.

The above and other objects of the invention are accomplished by the provision of a variable displacement hydrostatic pump of the type comprising housing means, a rotating fluid displacement mechanism rotatably disposed within the housing means, and a cam means operably associated with the fluid displacement mechanism and operable to vary the displacement of the hydrostatic pump in response to movement of a manual input member from a neutral position. The variable hydrostatic pump is adapted for use on a vehicle including at least one device operable to provide an electrical output signal having a first condition when operation of the hydrostatic pump is acceptable, and a second condition when operation of the hydrostatic pump is not acceptable.

The improved hydrostatic pump is characterized by the manual input member having associated therewith, for movement with the manual input member, an input shaft rotatable relative to the housing means. The input shaft defines a stop surface. An electromagnetic device is fixed relative to the housing means and includes a moveable plunger (armature) member disposed adjacent the stop surface. The plunger member is moveable between a retracted position when the electrical output signal is in the first condition, and an extended position, in engagement with the stop surface, when the electrical output signal is in the second condition. The plunger member and the stop surface are operable, when the plunger member is in the extended position, to prevent substantial movement of the manual input member in the input shaft from the neutral position.

DETAILED DESCRIPTION OF THE PREFERRED EMBODIMENTS

Figure 1:
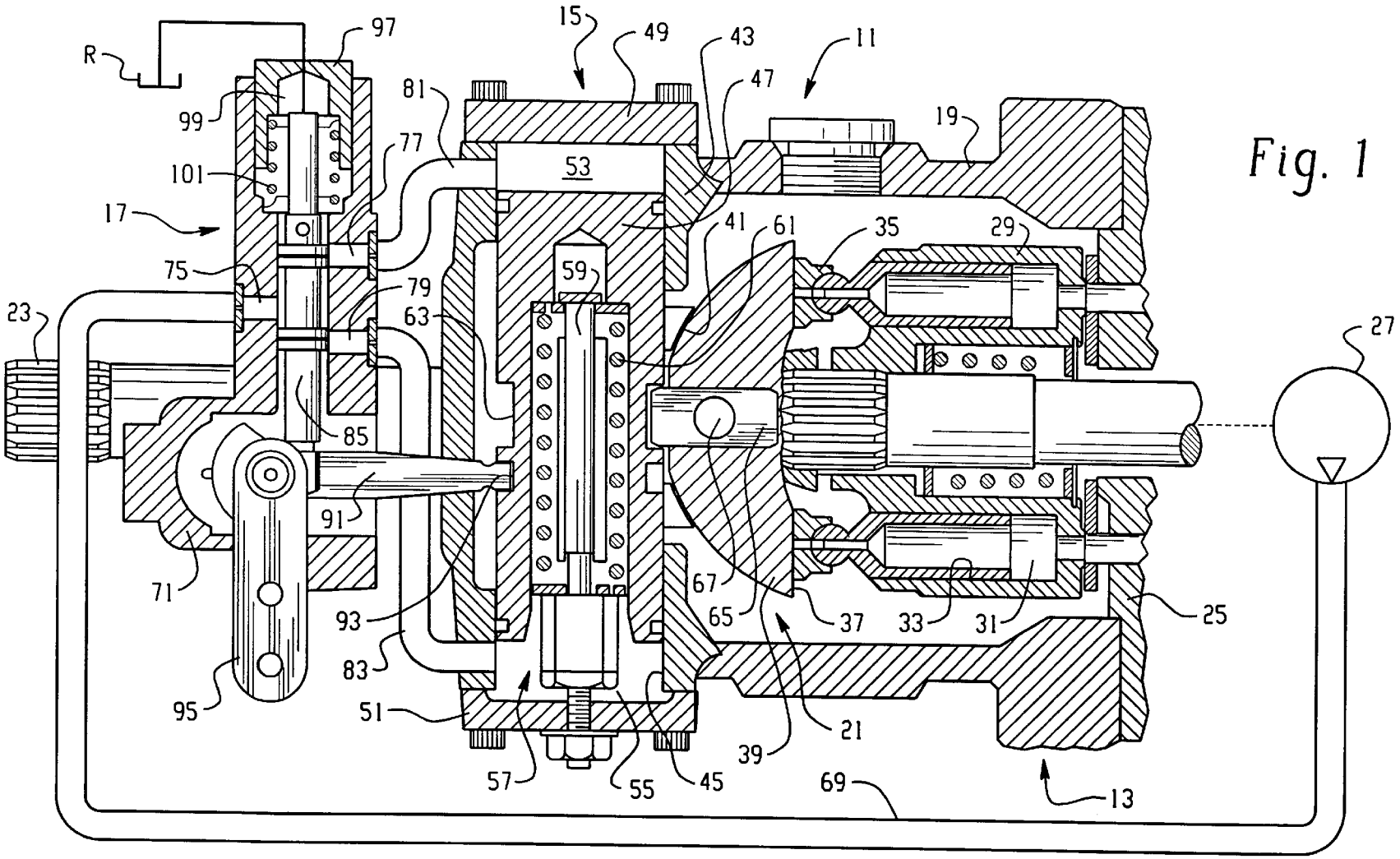
FIG. 1 is a somewhat schematic, axial cross-section of a variable displacement hydrostatic pump and control system of the type with which the present invention may be utilized.

Referring now to the drawings, which are not intended to limit the invention, FIG. 1 illustrates, somewhat schematically, a variable displacement axial piston pump, generally designated 11, of the type with which the present invention may be utilized. The pump 11 comprises three main portions: a pumping element 13; a fluid pressure actuated servo assembly 15; and a manual controller 17.

The pumping element 13 includes a pump housing 19 which defines an internal cavity 21. An input shaft 23 extends from the left in FIG. 1 into the internal cavity 21, and then extends to the right in FIG. 1 through an opening in a port housing 25 to drive a charge pump 27 (shown only schematically in FIG. 1).

Disposed about the input shaft 23, within the internal cavity 21, is a cylinder barrel 29, which is splined to the input shaft 23 to rotate therewith. The cylinder barrel 29 defines a plurality of cylinder bores 31, and disposed for reciprocating motion within each cylinder bore 31 is a piston 33. Each piston 33 includes a generally spherical head which is received within a piston shoe (or "slipper") 35. The piston shoes 35 are retained in contact with a swashplate 37 in a manner generally well known to those skilled in the art, and which forms no part of the present invention. The swashplate 37 is carried by a cam member 39 which is typically mounted in a cam support 41. In the subject embodiment, and by way of example only, the swashplate 37 merely comprises the surface of the cam member 39. In FIG. 1, the cam member 39 is shown in its neutral position, and movement of the cam member 39 from the neutral position, in either direction, will result in the stroke of the pistons 33 being changed in such a way that rotation of the barrel 29 will result in an output flow of pressurized fluid from the pumping element 13.

In the subject embodiment, and by way of example only, the fluid pressure actuated servo assembly 15 comprises a separate servo housing 43 suitably attached to the pump housing 19. The servo housing 43 defines a servo cylinder 45, and axially displaceable therein is a servo piston 47, which is shown in its neutral position in FIG. 1, corresponding to the neutral position of the cam member 39.

Bolted to the servo housing 43 is an upper end cap 49 and a lower end cap 51, the end caps 49 and 51 cooperating with the housing 43 and the piston 47 to define upper and lower servo chambers 53 and 55, respectively. The servo piston 47 is provided with a neutral centering spring assembly 57, the function of which is to return the servo piston 47 to its neutral position shown in FIG. 1, in the absence of control fluid pressure in either of the chambers 53 or 55. The neutral centering spring assembly 57 comprises a spring support member 59 and a coil compression spring 61 which is seated against the servo piston 47, in such a way that the spring 61 is compressed if the servo piston 47 moves either downward or upward in FIG. 1.

The servo piston 47 defines an annular groove 63 which receives the forward end of a servo piston follower 65. The follower 65 is attached to the cam member 39 by means of a follower pin 67 which is offset from the axis of pivotal movement of the cam member 39. As a result, movement of the servo piston in the downward direction will move the servo piston follower 65 downward, causing the cam member 39 to pivot counter-clockwise from its neutral position shown in FIG. 1. Conversely, movement of the servo piston 47 upward will cause the follower 65 to move upward, causing the cam member 39 to pivot clockwise from the neutral position.

In the operation of the axial piston pump 11, the vehicle operator is able to vary the pump displacement (e.g., to vary the speed of the vehicle), by controlling the flow of control fluid pressure from the charge pump 27 through a conduit 69 to the manual controller 17 which, in turn, controls the control fluid pressure in the servo chambers 53 and 55 and thus, the displacement of the cam member 39.

The manual controller 17 is generally well known to those skilled in the art and may be better understood by reference to U.S. Pat. No. 4,050,247, assigned to the assignee of the present invention and incorporated herein by reference. The controller 17 includes a controller housing 71 which defines a spool bore 73, a control port 75, which is in communication with the conduit 69, and a pair of servo ports 77, 79 which are in fluid communication with the servo chambers 53 and 55, respectively by means of a pair of conduits 81, 83, respectively. Disposed within the spool bore 73 is a control spool 85, including upper and lower spool lands which block fluid communication from the control port 75 to the servo ports 77 and 79 when the control spool 85 is in the centered, neutral position shown in FIG. 1.

Attached to the lower end of the control spool 85 is a feedback link 91 (see also FIGS. 2 and 3), which has its other end (right end in FIG. 1) received in an annular groove 93 defined by the servo piston 47. Also connected to the lower end of the control spool 85 is a control lever 95 by means of which the vehicle operator is able to shift the control spool 85 from its neutral position shown in FIG. 1 in either an upward direction or in a downward direction, to port control fluid pressure from the conduit 69 in a manner described previously. The upper end of the controller housing 71 receives a generally hollow plug 97 to define a cavity 99 which is in fluid communication with the system reservoir R, and therefore, is at substantially zero fluid pressure. Disposed within the cavity 99 is a centering spring assembly 101, the function of which is to bias the control spool 85 toward the neutral position shown in FIG. 1, in the absence of a control input, by means of the control lever 95.

As is well known to those skilled in the art, if the control lever 95 is rotated clockwise in FIG. 1, the control spool 85 moves upward, such that the upper spool land moves upward, permitting communication of control fluid pressure from the control port 75 to the servo port 77, and from there to the upper servo chamber 53. In turn, the servo piston 47 will move downward in FIG. 1 displacing the cam member 39 counterclockwise, as was described previously. After the appropriate amount of control fluid pressure has flowed into the upper servo chamber 53, the downward movement of the servo piston 47 moves the feedback link 91 downward, returning the control spool 85 to its centered, neutral position. The control lever 95 will remain in its displaced position (somewhat clockwise from the position shown in FIG. 1), the displaced position corresponding approximately to the commanded swash angle of the cam member 39.

When it is desired to stop the vehicle, the control lever 95 is moved counterclockwise back to the position shown in FIG. 1, moving the control spool 85 downward in FIG. 1, thus porting control fluid pressure from the control port 77 to the servo port 79. The control fluid pressure is then communicated through the conduit 83 to the lower servo chamber 55, moving the servo piston 47 upward, and returning the cam member 39 to the neutral position shown in FIG. 1. Thus, the vehicle is stopped and the control lever is again in its neutral position shown in FIG. 1.

Figure 4A:
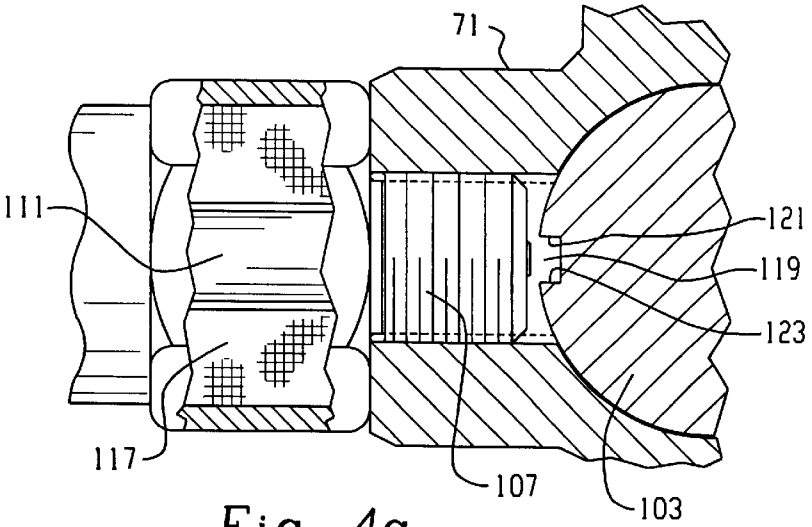
FIG. 4*a* is a greatly enlarged, fragmentary, axial cross-section, similar to FIG. 4, of the device of the present invention, partly broken away, and in its retracted position.
Figure 2:
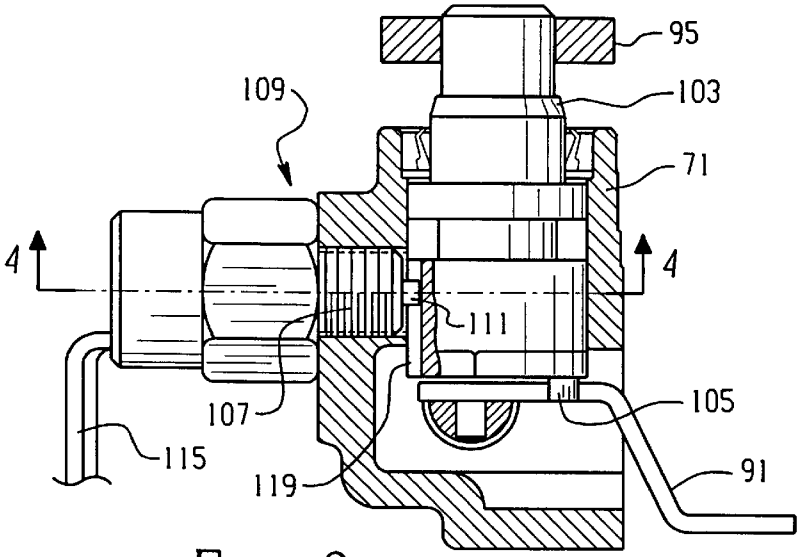
FIG. 2 is a somewhat enlarged, fragmentary, transverse cross-section of part of the manual controller shown in FIG. 1.
Figure 4:
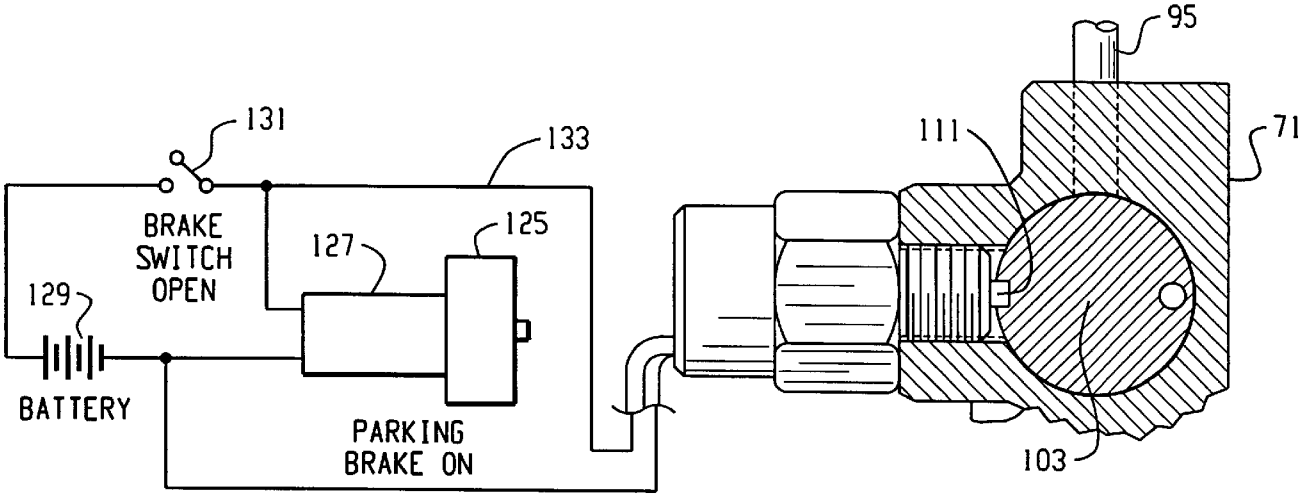
FIG. 4 is an axial cross-section illustrating one aspect of the invention, including a brake control system and associated circuitry, and taken on line 4—4 of FIG. 2, with the device of the invention in the disable position.
Figure 3:
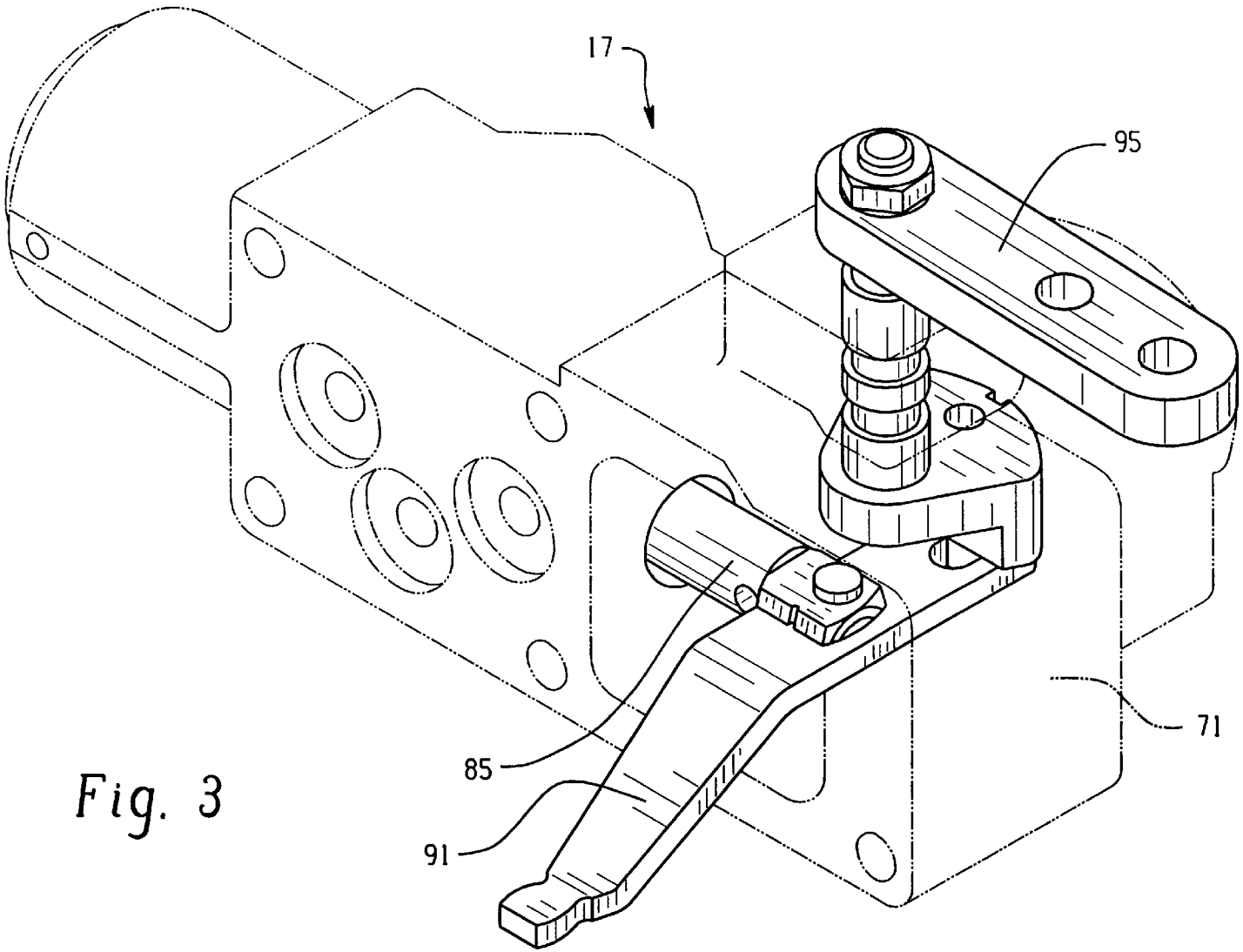
FIG. 3 is a perspective view of a manual controller of the general type shown in FIG. 1, illustrating an alternative embodiment of the linkage arrangement, but which is still of the type which may include the device of the present invention.

Referring now primarily to FIGS. 2 and 4, one important aspect of the present invention will be described. The radially inner end of the control lever 95 is disposed about the upper end of an input shaft 103. In FIG. 2, and by way of example only, the input shaft 103 is illustrated as being closely spaced apart within a portion of the controller housing 71, so that the input shaft 103 is rotatably supported relative to the controller housing 71. The feedback link 91 is shown in FIG. 2 as being attached to the lower end of the input shaft 103 and is fixed, as by means of a pin 105 such that rotation of the input shaft 103 will result in corresponding movement of the feedback link 91.

In threaded engagement with an internally threaded opening in the controller housing 71 is a fitting member 107 which comprises part of a solenoid assembly 109. Preferably, the solenoid assembly 109 is of the "pull" type and includes a plunger (armature) member 111 biased in a direction radially inward toward the axis of rotation of the input shaft 103 by a compression spring (not shown herein). When the solenoid assembly 109 receives an electrical input signal by means of a pair of electrical leads 115 a coil 117 is energized and exerts sufficient electromagnetic force on the plunger member 111, in opposition to the force of the spring, to pull the plunger member 111 radially outward, out of engagement with the input shaft 103.

Referring now primarily to FIG. 4, in conjunction with FIGS. 2 and 4*a*, it may be seen that the input shaft 103 defines, on its outer surface, a keyway 119, including a stop surface 121 and a stop surface 123. The keyway 119 is oriented and arranged on the input shaft 103 such that when the control lever 95 and the feedback link 91 are in the neutral position shown in FIG. 1, the keyway 119 is disposed adjacent the radially inward end of the plunger member 111. Then, if the condition of some other device on the vehicle changes, the result is an open circuit, such that the electrical output signal from that other device changes from a first condition to a second condition. When the electrical output signal of the other vehicle device was in its first condition, operation of the pump 11 was "acceptable", as was discussed in the BACKGROUND OF THE DISCLOSURE. When operation of the pump 11 is acceptable, as determined by the condition of the other vehicle device, the vehicle microprocessor turns on the signal 115 to the coil 117 of the solenoid assembly 109, thus pulling the plunger member 111 out to its retracted position (see FIG. 4*a*). With the plunger member 111 in the retracted position, the input shaft 103 is free to rotate within the controller housing 71, and the pump 11 may be operated in its normal manner, as described previously.

If the condition of the other vehicle device changes, indicating that operation of the hydrostatic pump 11 is not currently "acceptable", the vehicle microprocessor turns off the signal 115 to the coil 117, and the spring biases the plunger member 111 radially inwardly. If the control lever 95 is in the neutral position at that point in time, the radially inward end of the plunger member 111 will move into the keyway 119, adjacent each of the stop surfaces 121 and 123. Any subsequent attempt to move the control lever 95, whether intentional or accidental, will be prevented by the engagement of the plunger member 111 with one of the stop surfaces 121 or 123, depending upon the direction of attempted movement of the control lever 95.

If the control lever 95 is not in the neutral position shown in FIG. 1 at the time the signal 1 15 is turned off, the plunger member 111 will be spring biased radially inward into engagement with the outer surface of the input shaft 103. As soon as the control lever 95 passes through the neutral position, the spring will bias the plunger member 111 into the keyway 119, resulting in movement of the cam member 39 to the neutral position of FIG. 1 and preventing any subsequent movement of the control lever 95.

As one specific example of a system utilizing the present invention, FIG. 4 illustrates a hydraulic motor 125 having associated therewith a parking brake package 127, which is shown as being of the type in which the brake is normally applied, but can be disengaged. The system shown in FIG. 4 includes a battery 129 as the power source for the circuit and the circuit also has a manual switch 131 which, in the open position shown, results in the brake being applied, and the plunger 111 being spring biased into engagement with the keyway 119, as described previously. When the operator closes the switch 131, the brake is disengaged, and an electrical output signal 133 is transmitted to the coil 117 of the solenoid assembly 109. The plunger 111 is then retracted to the position shown in FIG. 4*a*, permitting normal operation of the manual controller 17.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A variable displacement hydrostatic pump of the type comprising housing means, a rotating fluid displacement mechanism rotatably disposed within said housing means; a cam means operably associated with said fluid displacement mechanism and operable to vary the displacement of said hydrostatic pump in response to movement of a manual input member from a neutral position; said variable hydrostatic pump being adapted for use on a vehicle including at least one device operable to provide an electrical output signal having a first condition when operation of said hydrostatic pump is acceptable, and a second condition when operation of said hydrostatic pump is not acceptable; characterized by:

(a) said manual input member has associated therewith, for movement with said manual input member, an input shaft rotatable relative to said housing means;

(b) said input shaft defining a stop surface;

(c) an electromagnetic device fixed relative to said housing means and including a moveable plunger member disposed adjacent said stop surface, and moveable between a retracted position, when said electrical output signal is in said first condition, and an extended position, in engagement with said stop surface, when said electrical output signal is in said second condition; and (d) said plunger member and said stop surface being operable, when said plunger member is in said extended position, to prevent substantial movement of said manual input member and said input shaft from said neutral position.

2. A variable displacement hydrostatic pump as claimed in claim 1, characterized by said electromagnetic device comprises an electromagnetic solenoid, said moveable plunger member comprises an armature, and said stop surface comprises an elongated slot defined by said input shaft.

3. A variable displacement hydrostatic pump as claimed in claim 2, characterized by said elongated slot defines first and second stop surfaces disposed on opposite sides of said armature, whereby, when said armature is in said extended position, said armature is operably associated with both of said first and second stop surfaces, thus preventing substantial movement of said manual input member and said input shaft in either rotational direction from said neutral position.

4. A variable displacement hydrostatic pump as claimed in claim 1, characterized by said fluid displacement mechanism comprises a cylinder barrel rotatably mounted within said housing means and defining a plurality of cylinders, and a piston disposed within each cylinder.

5. A variable displacement hydrostatic pump as claimed in claim 1, characterized by said cam means including a swash plate operably associated with each of said pistons to cause reciprocal movement thereof in response to rotation of said cylinder barrel when said cam means is displaced from a neutral position.

* * * * *